US010414567B2

(12) United States Patent
Palumbo

(10) Patent No.: US 10,414,567 B2
(45) Date of Patent: Sep. 17, 2019

(54) METHOD FOR VACUUM SKIN PACKAGING A PRODUCT ARRANGED IN A TRAY

(75) Inventor: Riccardo Palumbo, Arona (IT)

(73) Assignee: Cryovac, LLC, Charlotte, NC (US)

( * ) Notice: Subject to any disclaimer, the term of this patent is extended or adjusted under 35 U.S.C. 154(b) by 498 days.

(21) Appl. No.: 12/993,997

(22) PCT Filed: Apr. 30, 2009

(86) PCT No.: PCT/EP2009/055241

§ 371 (c)(1),
(2), (4) Date: Nov. 22, 2010

(87) PCT Pub. No.: WO2009/141214

PCT Pub. Date: Nov. 26, 2009

(65) Prior Publication Data

US 2011/0068042 A1 Mar. 24, 2011

(30) Foreign Application Priority Data

May 20, 2008 (EP) ..... 08104027

(51) Int. Cl.
*B65D 75/30* (2006.01)
*B65B 11/52* (2006.01)
*B65D 81/20* (2006.01)

(52) U.S. Cl.
CPC ..... *B65D 75/305* (2013.01); *B65B 11/52* (2013.01); *B65D 81/2015* (2013.01)

(58) Field of Classification Search
CPC ..... B65B 31/021; B65B 11/50; B65B 63/08; B65B 9/04; B65B 31/04; B65B 31/02;
(Continued)

(56) References Cited

U.S. PATENT DOCUMENTS 3,481,101 A 12/1969 Steadman
3,491,504 A * 1/1970 Pasco et al. ..... 53/427
(Continued)

FOREIGN PATENT DOCUMENTS

DE 1807446 U1 8/1978
DE 202004020968 U1 6/2006
(Continued)

*Primary Examiner* — Sameh Tawfik
(74) *Attorney, Agent, or Firm* — Daniel B. Ruble

(57) ABSTRACT

The invention relates to a vacuum skin packaging process, to a tray suitable for a vacuum skin packaging process and to the package thus obtained. The vacuum skin packaging process of the invention comprises providing a tray loaded with a product said tray comprising a bottom wall, a side wall upwardly extending from said bottom wall and terminating in an outwardly projecting horizontal rim, said side wall comprising at least one hole; placing the product loaded tray in a vacuum chamber; positioning a film above the product loaded tray; forming an airtight contact between the film and the rim of the tray; evacuating air from above the film to bring it into contact with a heating platen to heat the film; evacuating air from within the tray through the at least one hole; introducing air from above the film pushing the film in contact with the product and welding it to the inner surface of the tray closing the at least one hole in the side wall characterized in that the film is held in contact with the heating platen while air begins to be evacuated from within the tray. Preferably the film is positioned above the product loaded tray is a discrete piece of film having the size of the tray thus reducing the amount of film which is scrapped during a vacuum skin packaging process.

6 Claims, 3 Drawing Sheets

(58) Field of Classification Search
CPC .... B65B 31/00; B65D 75/305; B65D 81/2015
USPC ..... 53/427, 428, 433, 509, 111 R, 510, 432
See application file for complete search history.

(56) References Cited

U.S. PATENT DOCUMENTS

| | | | | | |
|---|---|---|---|---|---|
| 3,562,058 | A | * | 2/1971 | Boyd | 156/300 |
| 3,574,642 | A | | 4/1971 | Weinke | |
| 3,648,428 | A | * | 3/1972 | Colburn | 53/428 |
| 3,681,092 | A | | 8/1972 | Titchenal et al. | |
| 3,713,849 | A | | 1/1973 | Grindrod et al. | |
| 3,828,520 | A | * | 8/1974 | Merritt | 53/427 |
| 3,848,393 | A | * | 11/1974 | Monoghan | 53/427 |
| 3,950,919 | A | | 4/1976 | Perdue | |
| 4,055,672 | A | | 10/1977 | Hirsch et al. | |
| 4,062,449 | A | * | 12/1977 | Popkes et al. | 206/471 |
| 4,145,863 | A | * | 3/1979 | Hannon | 53/509 |
| RE30,009 | E | * | 5/1979 | Perdue et al. | 53/433 |
| 4,919,955 | A | | 4/1990 | Mitchell | |
| 4,933,193 | A | | 6/1990 | Fisher | |
| 5,346,735 | A | * | 9/1994 | Logan et al. | 428/36.7 |
| 5,419,101 | A | | 5/1995 | Gorlich et al. | |
| 5,667,827 | A | | 9/1997 | Breen et al. | |
| 5,711,978 | A | | 1/1998 | Breen et al. | |
| 6,625,955 | B2 | * | 9/2003 | Aylward | 53/412 |
| 6,698,165 | B1 | * | 3/2004 | Natterer | 53/509 |
| 6,843,039 | B1 | * | 1/2005 | Hanmer | 53/427 |
| 7,600,358 | B2 | | 10/2009 | Natterer et al. | |
| 7,712,289 | B2 | | 5/2010 | Von et al. | |
| 7,921,625 | B1 | | 4/2011 | Mayer | |
| 2005/0257501 | A1 | | 11/2005 | Natterer | |
| 2006/0147588 | A1 | | 7/2006 | Garwood | |
| 2006/0269707 | A1 | | 11/2006 | Berbert | |
| 2007/0022717 | A1 | | 2/2007 | Seggem | |
| 2007/0028566 | A1 | | 2/2007 | Sferrazza et al. | |
| 2009/0313954 | A1 | | 12/2009 | Aarts | |
| 2011/0068042 | A1 | | 3/2011 | Palumbo | |
| 2012/0204516 | A1 | | 8/2012 | Palumbo et al. | |

FOREIGN PATENT DOCUMENTS

| | | | |
|---|---|---|---|
| DE | 102006022418 | A1 | 11/2007 |
| DE | 202009010873 | U1 | 10/2009 |
| EP | 0 320 294 | A2 | 6/1989 |
| EP | 0320294 | A2 | 7/1994 |
| EP | 1728731 | B1 | 12/2009 |
| EP | 2284085 | B1 | 3/2013 |
| FR | 1258357 | A | 4/1961 |
| FR | 1286018 | A | 3/1962 |
| JP | S51153078 | U | 12/1976 |
| WO | 2007131683 | A2 | 11/2007 |
| WO | 2008022815 | A1 | 2/2008 |
| WO | 2009141214 | A1 | 11/2009 |
| WO | 2011012652 | A1 | 2/2011 |

* cited by examiner

METHOD FOR VACUUM SKIN PACKAGING A PRODUCT ARRANGED IN A TRAY

TECHNICAL FIELD

The present invention relates to a method for vacuum skin packaging a product arranged in a tray, to the tray adapted to carry out the vacuum skin packaging method and to the vacuum skin package thus obtained.

BACKGROUND ART

Vacuum packaging is a well known process for the packaging of a wide variety of food products which involves placing an article inside a thermoplastic film package, removing air from the interior of the package and sealing the thermoplastic film so that the packaging material remains in close contact with the article surfaces when the package is closed. Among the vacuum packaging processes vacuum skin packaging is commonly employed for the packaging of products such as fresh and frozen meat and fish, cheese, processed meat, ready meals and the like. Vacuum skin packaging is described in many references, including FR 1,258,357, FR 1,286,018, AU 3,491,504, U.S. RE 30,009, U.S. Pat. No. 3,574,642, U.S. Pat. No. 3,681,092, U.S. Pat. No. 3,713,849, U.S. Pat. No. 4,055,672, and U.S. Pat. No. 5,346,735.

Vacuum skin packaging is in one sense a type of thermoforming process in which an article to be packaged serves as the mould for a forming web. An article may be placed on a rigid or semi-rigid support generally tray-shaped, bowl-shaped or cup-shaped, having an opening and a rim formed on the periphery of said opening. Said tray-like configuration is generally obtained by a thermoforming step, either in-line or off-line. The supported article is then passed to a vacuum chamber where a length of a film, typically preheated in a separate pre-heating station, is positioned above the article placed on the support. Then the film is drawn upward against a heated dome, so that it is fully heated while held by suction in contact with the heated ceiling and walls of the dome. Then, vacuum is applied to the chamber below the film and all around the supported article. As soon as the pressure in the chamber has reached a suitable level below atmospheric pressure, the suction applied to the dome is released and the softened film is pulled downwards to drape over the contours of the article and in contact with the support. The movement of the film is controlled by vacuum and/or air pressure, and in a vacuum skin packaging arrangement, the interior of the container is vacuumized before final welding of the film to the support. The heated film thus forms a tight skin all around the product and it is welded to the support by differential air pressure, thus forming a seal wherever the two surfaces contact each other.

In known vacuum skin packaging processes the film is supplied to the vacuum chamber in the form of a continuous web of film drawn from a roll. The film is cut to the size of the support either within the vacuum chamber during the vacuum packaging process, or at the end of it once the package leaves the vacuum chamber. In either case an excess of the film with respect to the size of the support is fed to the vacuum chamber. The film excess is required to allow the film to be pulled from the roll and to be held in place above the supported article so that air can be removed from within the support. In general, more than one product loaded support is fed to the vacuum chamber at each cycle, typically 2, 3, 4 or even 6 supports at a time, so that an excess of film is also present between adjacent supports. The film is held above the product loaded supports by means of gripping chains, clamps, frames or equivalent holding means. At the end of the packaging process the excess film, which can be as much as 30% or 40% of the total amount of film on the roll, is cut from the package and scrapped.

The need to hold the film in place above the supported article is due to the fact that removal of air from the interior of the support is possible only as long as the film is held above the support and the product and in contact with the dome by suction. As soon as the film contacts the surface of the support along a closed line air can no longer be removed from within the support. Thus, particularly when a deep tray is used as a support for the product, pockets of air may remain entrapped between the film and the bottom surface of the support. The air pockets may negatively influence the shelf-life of the product as well as the impression that the consumer has of the package.

Skin packaging processes wherein the support is provided with perforations or vents to evacuate the air inside the support have been disclosed. U.S. Pat. No. 3,481,101 discloses a method for making skin packages using a support of an impervious material provided with apertures. According to this method once the product to be packaged is placed over the support held above an evacuation platen, a sheet of heated thermoplastic film is draped over the product and the support and vacuum is applied to the underside of the support to hermetically seal the film to the support. The package obtained with this method is not under complete vacuum. In particular, when the support is in the form of a tray, with a bottom wall and an upwardly extending side walls the film is drawn only partially into the tray, and does not form a skin on the product. EP-A-320,294 similarly discloses a skin packaging method wherein a product loaded tray provided with a vent in its side wall is placed on a vacuum platen; an excess of thermoplastic film is held over the tray by a frame and heated until it starts to sag over the product; then vacuum is applied from below the tray to pull the film to conform to the surface of the product and over and around the rim of the tray; the excess film is then trimmed.

Thus the need still exists for a vacuum skin packaging process that does not generate any residual waste material. The need also exists for a vacuum skin packaging process that allows the removal of air from within the support even after the film has contacted the support, to reduce the risk of leaving residual air pockets in the package.

A vacuum skin packaging process includes the following steps. A vacuum chamber is provided having an upper portion opposing a lower tray-holding portion. A semi-rigid or rigid tray loaded with a product is placed in the lower tray-holding portion of the vacuum chamber. The tray has a bottom wall and a circumferential side wall upwardly extending from the bottom wall and terminating in an outwardly projecting rim. The side wall has at least one hole. The film is heated while in contact with the upper portion of the vacuum chamber. Air is evacuated from within the tray through the at least one hole while the film is in contact with the upper portion of the vacuum chamber. Air is introduced to push the film from contact with the upper portion to contact the product and weld the film around the product to the whole of the inner surface of the tray not occupied by the product and to close the at least one hole in the side wall.

Accordingly, a first objective of the present invention is to provide a vacuum skin packaging process in which the removal of air from within the support can continue even after the film has come into contact with the surface of the support. A second objective of the present invention is to provide a vacuum skin packaging process that does not require the use of an excess of the film to produce a package.

DETAILED DESCRIPTION

A first object of the present invention is a vacuum skin packaging process comprising the steps of:

- providing a tray loaded with a product, said tray comprising a bottom wall, a circumferential side wall upwardly extending from said bottom wall and terminating in an outwardly projecting rim, said side wall comprising at least one hole;
- placing the product loaded tray in a vacuum chamber;
- positioning a film above the product loaded tray;
- evacuating air from above the film to bring it into contact with a heating platen to heat the film;
- evacuating air from within the tray through the at least one hole and optionally from below the film;
- introducing air from above the film pushing the film in contact with the product and welding it to the inner surface of the tray closing the at least one hole in the side wall characterised in that the film is held in contact with the heating platen by vacuum while air begins to be evacuated from within the tray.

In the process of the present invention the product to be packaged is placed into a tray provided with a bottom wall, a circumferential side wall upwardly extending from the bottom wall and terminating in an outwardly projecting horizontal rim. At least one hole is located in the side wall portion of the tray.

The term "side wall" is used herein to refer to both a single continuous wall circumferentially extending around the bottom wall, such as in a round or elliptical tray, and to a number of walls joined by corners, angled or rounded, such as in polygonal trays. Said wall or walls are connected to the bottom wall and extend upwardly from it defining the interior of the tray. A substantially horizontal continuous rim is connected to the side wall.

The tray comprises an inner surface and an outer surface, wherein the term "inner surface" indicates the surface intended to be in contact with the product and it includes the upper surface of the rim of the tray. The term "outer surface" indicates the exterior surface of the tray, that is the one that will not be in contact with the product and it includes the lower surface of the rim of the tray.

The tray is usually obtained by thermoforming, either in-line with the vacuum skin packaging process or, preferably, off-line in a separate operation. The at least one hole can be created in the side wall of the tray either during the thermoforming of the tray or in a following step.

The product is typically, but not necessarily, a food product. The product may be placed into the tray so that it lies completely below the rim of the tray, or it may be placed so that it extends somewhat above the rim of the tray.

Once the product 30 has been arranged into the tray 10, the product loaded tray is placed in a vacuum chamber 50 (FIG. 3). The vacuum chamber 50 comprises a lower tray holding cavity or lower tray-holding portion 54 and an upper heating platen or upper portion 52. A gasket is arranged at the edge of either one or both the upper heating platen or portion 52 and the lower cavity 54 to create an airtight closure of the chamber 50. Both the upper heating platen or upper portion 52 and the lower cavity 54 are provided with slits for drawing vacuum and ventilating when the upper heating platen and the lower cavity are closed. The upper heating platen may be in the form of a dome or flat.

Once the product loaded tray is placed in the lower tray holding cavity of the vacuum chamber 50, a length of the film 40 is positioned above the product 30 and the tray 10. As soon as the vacuum chamber 50 is closed, vacuum from above draws the film into contact with the heating platen. While the film is heated to a defined temperature vacuum is applied also below the tray so that the air present below the film and in the interior of the tray is evacuated. Typically the film is heated to a temperature of from about 140° C. to about 200° C. When the vacuum in the lower cavity has reached a certain value or after a set time, air is introduced from above causing the film to detach from the heating platen and conform to the shape of the product. During this stage air can still be removed through the hole(s) located in the side wall of the tray. The removal of air still trapped within the tray is facilitated by the downward motion of the film which is being pushed by the air introduced from above the heating platen. Through full ventilation from above, the heated film is pushed against the inner surface of the tray and welded to it all around the product. Once the welding of the film to the inner surface of the tray is completed, thereby closing the hole(s) in the side wall of the tray, the vacuum chamber is opened to remove the package 20, thus leaving the vacuum chamber ready for a new cycle. Typically before opening the vacuum chamber air is reintroduced also in the lower cavity.

The film 40 may be held by the heating platen or upper portion 52 above, and not in contact with, the rim 4 of the tray. Air is then removed not only from the at least one hole 8 in the side wall of the tray 10 but also through the gap between the film held in contact with the heating platen by suction and the rim of the tray. Air can still be removed through the at least one hole 8 when the gap between the film and the rim of the tray is no longer present, i.e. when the air is introduced into the vacuum chamber from above the film, it is thus possible to reduce the amount of air trapped in the package at the end of the vacuum skin packaging process.

Preferably, the film is brought into airtight contact with the rim of the tray by the closing of the upper heating platen and the lower cavity. Vacuum from above draws the film into contact with the heating platen and while the film is heated vacuum is applied also below the tray so that the air trapped in the interior of the tray by the film is evacuated through the hole(s) located in the side wall of the tray.

The film may be in the form of a continuous web, unwound from a roll. A cutting operation is required to cut the film to the size of the tray, wherein "size of the tray" means an area equal to, slightly smaller or slightly bigger than the area comprised by the rim of the tray. "Slightly" is used herein to indicate that the size of the film once welded to the tray may differ from the size of the tray by up to 10 mm, preferably up to 5 mm, more preferably by up to 3 mm. Cutting of the film may take place either within the vacuum chamber during the vacuum packaging cycle or outside the vacuum chamber before or after the vacuum skin packaging cycle. In either case the film will not be welded to the outer surface of the tray but only to the upper surface of the rim and to the part of the inner surface of the tray that is not covered by the product.

The use of the tray provided with hole(s) allows to modify the timing of the different steps of the vacuum skin packaging process reducing the overall length of the cycle. In fact it allows to begin the introduction of air from above the film before a full vacuum is created within the tray. Air can still be removed from the interior of the tray while the film is conforming to the shape of the product, the downward motion of the film further helping to push the residual air out of the tray through the hole(s).

In a second embodiment of the process of the present invention, once the product 30 has been loaded in a tray 10 comprising at least one hole 8 in its side wall, the tray loaded product is placed in the lower cavity 54 of the vacuum chamber 50. Then a discrete piece of film 40 having the size of the tray 10 is positioned above the product loaded tray and brought in airtight contact with the rim 4 of the tray by the closing of the upper heating platen or upper portion 52 and the lower cavity or lower tray-holding portion 54. While the film 40 is heated to a suitable forming temperature vacuum is applied also below the tray 10 so that the air in the interior of the tray is evacuated. When the vacuum in the lower cavity has reached a certain value or after a set time, air is introduced from above causing the film to detach from the heating platen and conform to the shape of the product. Through full ventilation from above, the heated film is pushed against the inner surface of the tray and welded to it all around the product. Then air is allowed into the vacuum chamber which is then opened releasing the package. Thus, in its second embodiment the vacuum skin packaging process comprises:

providing a tray loaded with a product, said tray comprising a bottom wall, a circumferential side wall upwardly extending from said bottom wall and terminating in an outwardly projecting rim, said side wall comprising at least one hole;

placing the product loaded tray in a vacuum chamber;

positioning a discrete piece of film having the size of the tray above the product loaded tray forming an airtight contact between the film and the rim of the tray;

evacuating air from above the film to bring it into contact with a heating platen to heat the film while air begins to be evacuated from within the tray through the at least one hole;

introducing air from above the film pushing the film in contact with the product and welding it to the inner surface of the tray closing the at least one hole in said side wall.

Preferably, the film is held in contact with the heating platen by vacuum while being positioned above the product loaded tray and while an airtight contact is formed between the film and the rim of the tray. The airtight contact is obtained by the closing of the heating platen and the lower cavity.

By providing the film as a discrete piece having a size matching that of the tray no waste of the film is created at the end of the packaging cycle. For instance, the discrete pieces of film could be cut to the desired length from continuous webs having the same width as that of the tray or they could be provided as stacks or boxes of discrete pieces of film of the correct size. Other arrangements can be envisioned to maximise the film usage. Thus, the vacuum skin packaging process of the invention allows a significant reduction in the amount of film waste. Furthermore, when discrete trays are used in the process, instead of trays formed in-line from a continuous web, no scrap of any material is generated by the packaging process.

In a further embodiment of the vacuum skin packaging process of the invention once the product has been arranged into the tray the film is positioned above the product and the tray. The film is then secured to the rim of the tray in at least one spot. The film may be secured by heat-sealing, welding, gluing, stitching or in any other suitable method known in the art. Preferably, the film is heat-sealed to the rim of the tray. Preferably, the film is secured to the rim of the tray in more than one spot, typically in at least two diametrically opposed spots around the rim of the tray. More preferably, the film is secured to the rim of the tray in at least four spots. The four spots are evenly distributed around the rim of the tray, preferably near the corner areas when the tray has a polygonal shape.

Alternatively, the film may be secured to the whole rim of the tray. Preferably the film is heat-sealed to the whole rim of the tray. Heat-sealing may be carried out by any conventional means either in-line or off-line with the subsequent vacuum skin process.

The film may be fed from a roll in the form of a continuous web or, preferably, it can be provided in the form of a discrete piece of material of a size matching the size of the tray. In the first case, it is preferred to separate the tray from the continuous web of film once the film is secured to the tray and before loading the tray-product-film assembly into the vacuum chamber. In the second case the discrete piece of material may be cut from a continuous roll immediately before sealing or, in alternative, in a previous separate step.

After the film has been secured to the rim of the tray, the product loaded tray is moved to the vacuum chamber. Then the upper heating platen and the lower cavity are closed and, when the film is secured to the rim of the tray only in a discrete number of spots, the film is brought into airtight contact with the whole of the rim of the tray. The packaging cycle then follows the same steps outlined above. Vacuum from above draws the film into contact with the heating platen. While the film is heated to a temperature suitable for forming, the air inside the tray is evacuated through the hole(s) located in the side wall of the tray. Then air introduced into the vacuum chamber from above causes the heated film to detach from the upper heating platen, drop over the product and weld to the inner surface of the tray not covered by the product. Once the welding of the film to the inner surface of the tray is completed, thereby closing the hole(s) in the side wall of the tray, the lower cavity is also ventilated. The vacuum chamber is then opened in order to remove the package, thus leaving the vacuum chamber ready for a new cycle.

Thus in this third embodiment the vacuum skin packaging process of the invention comprises:

providing a tray loaded with a product, said tray comprising a bottom wall, a circumferential side wall upwardly extending from said bottom wall and terminating in an outwardly projecting rim, said side wall comprising at least one hole;

positioning a film above the product loaded tray;

securing said film to the rim of the tray in at least one spot;

placing the product loaded tray in a vacuum chamber;

forming an airtight contact between the film and the rim of the tray;

evacuating air from above the film to bring it into contact with a heating platen to heat the film while air is evacuated from within the tray through the at least one hole;

introducing air from above the film pushing the film in contact with the product and welding it to the inner surface of the tray closing the at least one hole in said side wall.

Although the different embodiments of the packaging process of the present invention have been described with reference to a single package being produced per cycle, the process is not limited to it and it is clear to the skilled person that the process equally applies to a higher number of packages per cycle.

A second object of the present invention is a tray comprising a bottom wall, a circumferential side wall upwardly extending from said bottom wall and terminating in an outwardly projecting rim, said side wall comprising at least one hole. The tray may comprise any number of holes in its side wall. The tray may comprise 1 hole, 2 holes, 3 holes, 4 holes, 5 holes, 6 holes, 8 holes, 10 holes, 12 holes, 15 holes, 16 holes, 18 holes, 20 holes or more. In practice, in most applications the use of trays having 2 holes, 3 holes, 4 holes, 6 holes, 8 holes, 10 holes, 12 holes may be preferred.

The diameter of the holes is at least 0.5 mm, 0.65 mm, 0.75 mm, 0.85 mm, 1 mm, 1.2 mm, 1.4 mm, 1.5 mm, 1.75 mm, 2.0 mm, 2.25 mm, 2.5 mm, 2.75 mm, 3.0 mm. Preferably the diameter of the holes is at least 0.75 mm, 0.85 mm, 1 mm, 1.1 mm, 1.2 mm, 1.3 mm, 1.4 mm, 1.5 mm, 1.75 mm, 2.0 mm, 2.25 mm, 2.5 mm, 2.75 mm, 3.0 mm. The diameter is typically not more than 15 mm, 12 mm, 10 mm, 9 mm, 8 mm, 7.5 mm. Although holes having a diameter of less than 0.75 mm can be used the load loss through smaller holes during the air removal step of the packaging cycle tends to limit the beneficial effect of the holes in the packaging process of the present invention.

Without being bound by theory it is believed that the effect of the hole(s) on the vacuum skin packaging process can be correlated to the total number of holes and their size. Preferably the number and size of the hole(s) is such that $nA \geq 4$ mm$^2$, $nA \geq 5$ mm$^2$, preferably $nA \geq 6$ mm$^2$, more preferably $nA \geq 7$ mm$^2$, wherein n indicates the number of holes and A the hole area.

Accordingly, when n=1 then the hole has a diameter of at least 2.25 mm, preferably of at least 2.52 mm, more preferably of at least 2.76 mm and even more preferably of at least 3 mm.

When a higher number of holes is present in the tray a higher total area (nA) may be preferred. For instance when n=4 it may be preferable that $A \geq 6/4$ mm$^2$, $A \geq 7/4$ mm$^2$, $A \geq 9/4$ mm$^2$, or even that $A \geq 12.5/4$ mm$^2$ which correspond to a hole diameter of at least 1.38 mm, of at least 1.5 mm, of at least 1.69 mm or even at least 2 mm.

The holes may have any appropriate shape, for example circular, square, hexagonal or elliptical. Typically, but not necessarily, the holes have the same size and shape. In the case of a non-circular shape, the diameter for the purpose of the above relationship is taken to be the diameter of the circle with the same area. The term "hole" may also include the concept of cuts or cross-shaped, V-shaped, U-shaped slits that under the pull of vacuum form an opening which allows removal of air from within the tray, the area of the opening satisfying the relationship above.

To reduce the risk of spillage of liquid products and/or the clogging of the hole(s), the hole(s) may be positioned close to the rim in the upper area of the side wall. The hole(s) may be preferably positioned in the upper half of the side wall, more preferably in the upper third of the side wall and even more preferably in the upper fourth of the side wall.

The hole(s) may be anywhere in the side wall, although when more than one hole is present it may be preferable that the holes are evenly distributed across the side wall area.

When the tray has a polygonal shape, such as square, rectangular, hexagonal, octagonal and the like, the hole(s) is preferably positioned in the corner(s) of the side wall. It has been observed that during a vacuum skin packaging process the film contacts the surface of the tray in the corner areas later than it does in the other areas of the side wall. Thus, hole(s) positioned in the corner areas will be closed by the film at a later stage of the vacuum skin process allowing more air to be removed from within the tray. Furthermore, the corner areas are the ones where isolated pockets of air are often created by the product touching the sides of the wall of the tray. Thus, positioning the hole(s) in the corner areas may further reduce the risk of having residual air pockets in the final package.

The tray may be provided with one or more horizontal ledges in the upper part of the side wall where the hole(s) is suitably located. The ledge(s) are located in the upper fourth of the side wall area, at some distance from the horizontal rim of the tray. Typically the ledge(s) is at a distance of at least 3 mm, 5 mm, 8 mm or even 10 mm from the rim of the tray. Preferably the ledge(s) is at a distance of from 5 mm to 10 mm below the horizontal rim of the tray.

The ledge may be continuous, extending along the whole circumference of the side wall or it may comprise a number of discrete ledges. It has been observed that the horizontal positioning of the hole(s) in said ledge is also effective in postponing the closing of the hole(s) itself by the film during the packaging process.

These and other design features may be combined to provide inventive trays with tailored properties. Other design features in the tray are for instance the angle of curvature of the corner in the tray, the depth of the ledge, its design etc.

Non-limiting examples of suitable combination of features in the tray of the invention are for instance: hole(s) positioned in the corner(s) of the side wall of the tray in the upper half of the side wall; hole(s) positioned in the corner(s) of the side wall of the tray in the upper third of the side wall; hole(s) satisfying the relationship $nA \geq 4$ mm$^2$, $nA \geq 5$ mm$^2$, $nA \geq 6$ mm$^2$, $nA \geq 7$ mm$^2$, $nA \geq 9$ mm$^2$; hole(s) satisfying the relationship $nA \geq 4$ mm$^2$, $nA \geq 5$ mm$^2$, $nA \geq 6$ mm$^2$, $nA \geq 7$ mm$^2$ positioned in the corner(s) of the side wall of the tray; hole(s) satisfying the relationship $nA \geq 4$ mm$^2$, $nA \geq 5$ mm$^2$, $nA \geq 6$ mm$^2$, $nA \geq 7$ mm$^2$ positioned in the corner(s) of the side wall of the tray in the upper half of the side wall; hole(s) positioned in one or more horizontal ledges located in the corner(s) of the side wall of the tray; hole(s) positioned in one or more horizontal ledges in the side wall of the tray; hole(s) satisfying the relationship $nA \geq 4$ mm$^2$, $nA \geq 5$ mm$^2$, $nA \geq 6$ mm$^2$, $nA \geq 7$ mm$^2$ positioned in one or more horizontal ledges located in the corner(s) of the side wall of the tray; hole(s) satisfying the relationship $nA \geq 4$ mm$^2$, $nA \geq 5$ mm$^2$, $nA \geq 6$ mm$^2$, $nA \geq 7$ mm$^2$ positioned in one or more horizontal ledges located in the side wall of the tray; four holes positioned in the corners of the side wall of a rectangular tray; four holes positioned in the corners of the side wall of a square tray; four holes positioned in the corners of the side wall of a rectangular tray satisfying the relationship $A \geq 6/4$ mm$^2$, $A \geq 7/4$ mm$^2$, $A \geq 9/4$ mm$^2$, $A \geq 12.5/4$ mm$^2$; four holes positioned in the corners of the side wall of a rectangular tray in the upper half of the side wall; four holes satisfying the relationship $A \geq 6/4$ mm$^2$, $A \geq 7/4$ mm$^2$, $A \geq 9/4$ mm$^2$, $A \geq 12.5/4$ mm$^2$ positioned in one or more horizontal ledges located in the corner(s) of the side wall of the tray; eight holes positioned in the corners of the side wall of a rectangular tray; eight holes satisfying the relationship $A \geq 6/8$ mm$^2$, $A \geq 7/8$ mm$^2$, $A \geq 9/8$ mm$^2$, $A \geq 12.5/8$ mm$^2$ positioned in one or more horizontal ledges located in the corner(s) of the side wall of the tray.

The trays are made of monolayer or multilayer thermoplastic materials. Preferably the tray is provided with gas barrier properties. As used herein such term refers to a film or sheet of material which has an oxygen transmission rate of less than 200 cm$^3$/m$^2$-day-bar, less than 150 cm$^3$/m$^2$-day-bar, less than 100 cm$^3$/m$^2$-day-bar as measured according to ASTM D-3985 at 23° C. and 0% relative humidity.

Suitable materials for gas barrier monolayer thermoplastic trays are for instance polyesters, polyamides and the like.

Preferably the tray is made of a multilayer material comprising at least one gas barrier layer and at least one heat-sealable layer to allow welding of the skin film to the surface of the tray. Gas barrier polymers that can be employed for the gas barrier layer are PVDC, EVOH, polyamides, polyesters and blends thereof.

PVDC is any vinylidene chloride copolymer wherein a major amount of the copolymer comprises vinylidene chloride and a minor amount of the copolymer comprises one or more unsaturated monomers copolymerisable therewith, typically vinyl chloride, and alkyl acrylates or methacrylates (e.g. methyl acrylate or methacrylate) and the blends thereof in different proportions. Generally a PVDC barrier layer will contain plasticisers and/or stabilizers as known in the art.

As used herein, the term EVOH includes saponified or hydrolyzed ethylene-vinyl acetate copolymers, and refers to ethylene/vinyl alcohol copolymers having an ethylene comonomer content preferably comprised from about 28 to about 48 mole %, more preferably, from about 32 to about 44 mole % ethylene, and even more preferably, and a saponification degree of at least 85%, preferably at least 90%.

The term polyamides is intended to refer to both homo- and co- or ter-polyamides. This term specifically includes aliphatic polyamides or co-polyamides, e.g., polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partially aromatic polyamides or co-polyamides, such as polyamide 6I, polyamide 6I/6T, polyamide MXD6, polyamide MXD6/MXDI, and blends thereof.

The term polyesters refers to polymers obtained by the polycondensation reaction of dicarboxylic acids with dihydroxy alcohols. Suitable dicarboxylic acids are, for instance, terephthalic acid, isophthalic acid, 2,6-naphthalene dicarboxylic acid and the like. Suitable dihydroxy alcohols are for instance ethylene glycol, diethylene glycol, 1,4-butanediol, 1,4-cyclohexanedimethanol and the like. Examples of useful polyesters include poly(ethylene terephthalate), and copolyesters obtained by reacting one or more dicarboxylic acids with one or more dihydroxy alcohols.

The thickness of the gas barrier layer will be set in order to provide the tray with an oxygen transmission rate at 23° C. and 0% relative humidity lower than 50, preferably lower than 10 $cm^3/m^2$.d.atm.

Generally the heat-sealable layer will be selected among the polyolefins, such as ethylene homo- or co-polymers, propylene homo- or co-polymers, ethylene/vinyl acetate copolymers, ionomers, and the homo- and co-polyesters, e.g. PETG, a glycol-modified polyethylene terephthalate. As used herein, the term "copolymer" refers to a polymer derived from two or more types of monomers, and includes terpolymers. Ethylene homopolymers include high density polyethylene (HDPE) and low density polyethylene (LDPE). Ethylene copolymers include ethylene/alpha-olefin copolymers and ethylene/unsaturated ester copolymers. Ethylene/alpha-olefin copolymers generally include copolymers of ethylene and one or more comonomers selected from alpha-olefins having from 3 to 20 carbon atoms, such as 1-butene, 1-pentene, 1-hexene, 1-octene, 4-methyl-1-pentene and the like.

Ethylene/alpha-olefin copolymers generally have a density in the range of from about 0.86 to about 0.94 $g/cm^3$. The term linear low density polyethylene (LLDPE) is generally understood to include that group of ethylene/alpha-olefin copolymers which fall into the density range of about 0.915 to about 0.94 $g/cm^3$ and particularly about 0.915 to about 0.925 $g/cm^3$. Sometimes linear polyethylene in the density range from about 0.926 to about 0.94 $g/cm^3$ is referred to as linear medium density polyethylene (LMDPE). Lower density ethylene/alpha-olefin copolymers may be referred to as very low density polyethylene (VLDPE) and ultra-low density polyethylene (ULDPE). Ethylene/alpha-olefin copolymers may be obtained by either heterogeneous or homogeneous polymerization processes.

Another useful ethylene copolymer is an ethylene/unsaturated ester copolymer, which is the copolymer of ethylene and one or more unsaturated ester monomers. Useful unsaturated esters include vinyl esters of aliphatic carboxylic acids, where the esters have from 4 to 12 carbon atoms, such as vinyl acetate, and alkyl esters of acrylic or methacrylic acid, where the esters have from 4 to 12 carbon atoms.

Ionomers are copolymers of an ethylene and an unsaturated monocarboxylic acid having the carboxylic acid neutralized by a metal ion, such as zinc or, preferably, sodium.

Useful propylene copolymers include propylene/ethylene copolymers, which are copolymers of propylene and ethylene having a majority weight percent content of propylene, and propylene/ethylene/butene terpolymers, which are copolymers of propylene, ethylene and 1-butene.

Additional layers, such as adhesive layers, to better adhere the gas-barrier layer to the adjacent layers, may be present in the gas barrier material for the tray and are preferably present depending in particular on the specific resins used for the gas barrier layer.

In case of a multilayer structure, part of it can be foamed and part can be cast. For instance, the multilayer material used to form the tray may comprise (from the outermost layer to the innermost food-contact layer) one or more structural layers, typically of a material such as foam polystyrene, foam polyester or foam polypropylene, or a cast sheet of e.g. polypropylene, polystyrene, poly(vinyl chloride), polyester or cardboard; a gas barrier layer and a heat-sealable layer. An easy-to-open frangible layer may be positioned adjacent the heat-sealable layer to facilitate the opening of the final package. Polymer blends with low cohesive strength that can be used as frangible layer are for instance those described in WO99/54398. The overall thickness of the tray will typically be up to 10 mm, preferably it will be comprised between 0.2 and 8 mm and more preferably between 0.2 and 7 mm.

A third aspect of the present invention is a vacuum skin package comprising a tray onto which a product is loaded, said tray provided with at least one hole located in the side wall portion of the tray, and a film draped over the product and welded to the inner surface of the tray not covered by the product. The film forms a skin over the product and the inner surface of the tray. As a full vacuum is created inside the package the film is welded to the whole of the inner surface of the tray not occupied by the product. The film welds only to the inner surface of the tray. The film welds efficiently to the inner surface of the tray so that no air can enter the package through the hole(s) in the side wall of the tray. The hole(s) is in fact closed by the film. The film does not conform or weld to any part of the outer surface of the tray.

To facilitate opening of the package either one of the tray or the film may be provided with a frangible easy-to-open layer. Alternatively, one of the heat-sealable surface of the tray or the film may be made of a suitable peelable composition as it is known in the art.

The package may be obtained by any one of the vacuum skin packaging processes described above.

Typically the film is a flexible multilayer material comprising at least a first outer heat-sealable layer capable of welding to the inner surface of the tray, optionally a gas barrier layer and a second outer heat-resistant layer. The polymers used in said multilayer material should be easily formable as the film needs to be stretched and softened by the contact with the heating platen before being draped down on the product and tray. The film also has to drape over the product conforming to its shape and to the inner shape of the tray.

The outer heat-sealable layer may comprise any polymer capable of welding to the inner surface of the tray. Suitable polymers for the heat-sealable layer may be ethylene homo- or co-polymers, like LDPE, ethylene/alpha-olefin copolymers, ethylene/acrylic acid copolymers, ethylene/methacrylic acid copolymers, or ethylene/vinyl acetate copolymers, ionomers, co-polyesters, e.g. PETG. Preferred materials for the heat-sealable layer are LDPE, ethylene/alpha-olefin copolymers, for instance LLDPE, ionomers, ethylene/vinyl acetate copolymers and blends thereof.

Depending on the product to be packaged the film may comprise a gas barrier layer. The gas barrier layer typically comprises oxygen impermeable resins like PVDC, EVOH, polyamides and blends of EVOH and polyamides. Typically the thickness of the gas barrier layer is set in order to provide the film with an oxygen transmission rate at 23° C. and 0% relative humidity lower than 10 $cm^3/m^2$.d.atm, preferably lower than 5 $cm^3/m^2$.d.atm.

Common polymers for the outer heat-resistant layer are for instance ethylene homo- or co-polymers, ethylene/cyclic-olefin copolymers, such as ethylene/norbornene copolymers, propylene homo- or co-polymers, ionomers, polyesters, polyamides.

The film may also comprise other layers such as adhesive layers, bulk layers and the like to provide the necessary thickness to the film and improve the mechanical properties thereof, such as puncture resistance, abuse resistance, formability and the like.

The film is obtained by any suitable co-extrusion process, either through a flat or a round extrusion die, preferably by cast co-extrusion or by hot-blown. Preferably, for use in a vacuum skin packaging process the film is substantially non oriented. Typically the film, or only one or more of the layers thereof, is cross-linked to e.g. improve the strength of the film and/or the heat resistance when the film is brought in contact with the heating platen during the vacuum skin packaging process. Cross-linking may be achieved by using chemical additives or by subjecting the film layers to an energetic radiation treatment, such as a high-energy electron beam treatment, to induce cross-linking between molecules of the irradiated material.

Films suitable for this application have a thickness in the range of from 50 to 200 microns, from 70 to 150 microns. Suitable films for use as films in a vacuum skin packaging process are for instance those sold by Cryovac® under the trade names TS201®, TH300®, VST™0250, VST™0280.

BRIEF DESCRIPTION OF THE DRAWINGS

Embodiments of the present invention will be described, by way of example only, with reference to the accompanying drawings in which:

FIG. 1 shows a rectangular tray of the invention. Tray 10 comprises a bottom wall 2 and extending upwardly from said bottom wall a side wall 3. Side wall 3 forms the perimeter of the tray. The side wall terminates in a continuous rim 4 outwardly extending from the side wall. The side wall comprises four angled corners 6. A ledge 7 is present in each corner, close to the upper end of the side wall but at some distance below the rim of the tray. In the embodiment shown in FIG. 1, four holes 8 are provided in tray 10. One hole is located in each ledge 7. The placement of the holes is selected to be sufficiently high along the side wall of the tray to reduce the risk of clogging of the holes during the loading of the product or its shifting during the handling of the product loaded tray. The positioning of the holes in the recessed ledges 7 located in the corner areas of the side wall facilitates the air removal step as the film adheres later to these areas of the tray, thus allowing more air to be removed from the interior of the tray.

FIG. 2 shows a cross-sectional view of a package 20 obtained by the vacuum skin packaging process of the invention. Once the vacuum packaging process has been completed, the film 40 forms a tight skin over the product and welds to the inner surface of the tray which is not covered by the product sealing the holes in the side wall of the tray.

Figure 1:
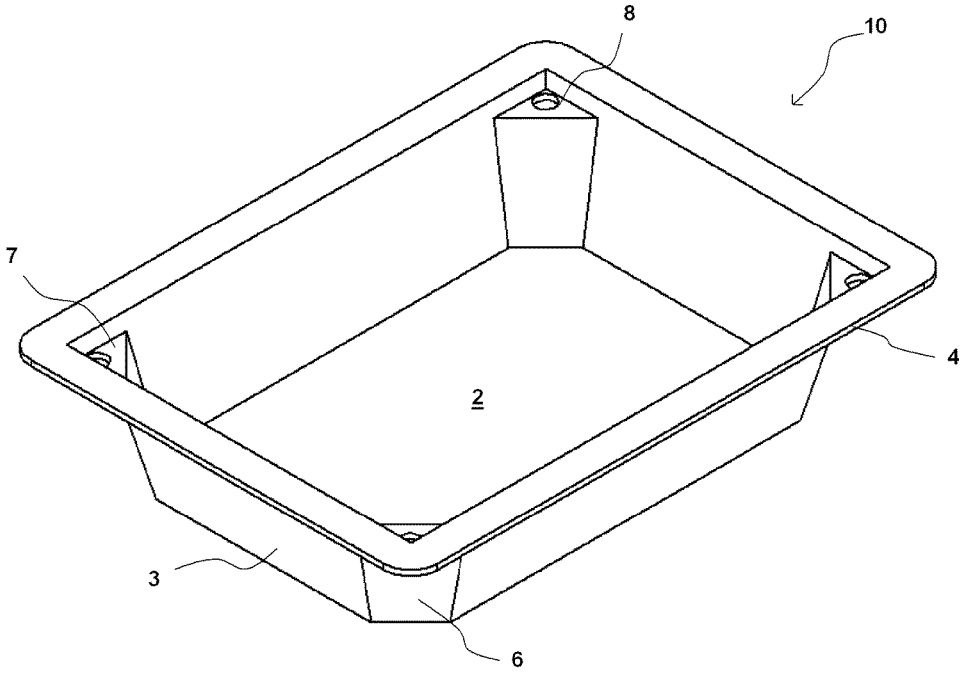
FIG. 1 is a perspective view of a tray according to one embodiment of the present invention.
Figure 2:
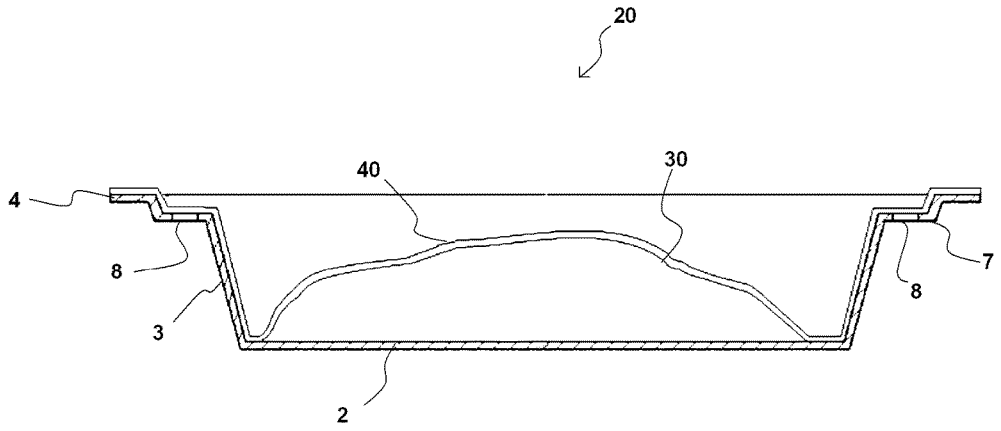
FIG. 2 is a cross-sectional view of a package according to one embodiment of the present invention
Figure 3:
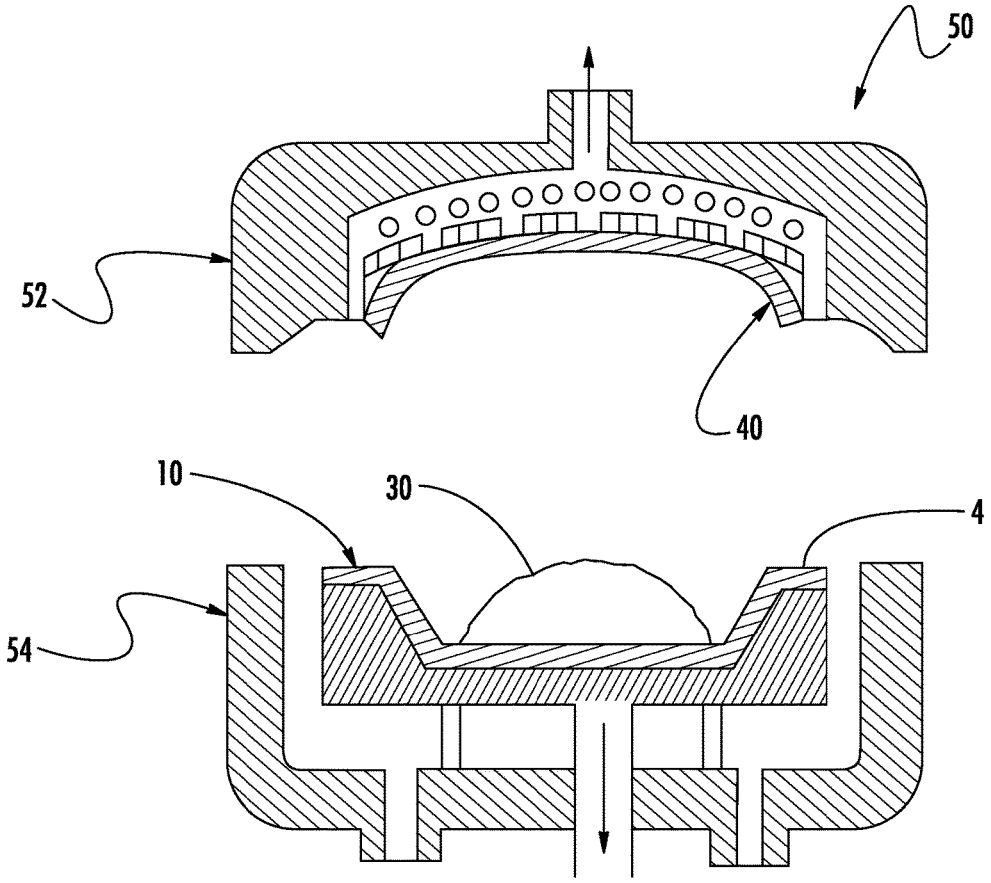
FIG. 3 is a representative schematic view of the vacuum chamber 50 used in a process embodiment of the present invention.

Package 20 comprises a rectangular tray 10, a product 30 arranged in the tray and skin film 40 draped over the product and welded to the side wall 3 and rim 4 of the tray in a skin packaging arrangement. Film 40 conforms tightly with the whole inner surface of the tray and seals holes 8 located in recessed portions 7 of side wall 3. As can be seen in FIG. 2, film 40 is welded to the rim of the tray but does not extend beyond said rim. The film is not welded to the outer surface of the tray in any place.

The seal between the inner surface of the tray and the heat-sealable layer of the film is such that no air penetrates the package through the holes in the tray. Such a hermetic seal is obtained by suitably selecting the polymers making up the heat-sealable layers of both the film and the tray. For instance strong seals in a vacuum skin package can be obtained between a first LDPE or LLDPE layer and a second ethylene/vinyl acetate copolymer layer. Compared to prior art vacuum skin packages the shelf-life of products stored in the package of the invention is the same.

The invention claimed is:

1. A vacuum skin packaging process comprising the steps of:

providing a vacuum chamber comprising an upper portion opposing a lower tray-holding portion;

placing in the lower tray-holding portion of the vacuum chamber a semi-rigid or rigid tray loaded with a product, the tray comprising a bottom wall, a circumferential side wall upwardly extending from the bottom wall and terminating in an outwardly projecting rim, the side wall comprising at least one hole;

heating a film in contact with the upper portion of the vacuum chamber;

evacuating air from within the tray through the at least one hole while the film is in contact with the upper portion of the vacuum chamber; and introducing air to push the film from contact with the upper portion to contact the product and weld the film around the product to the whole of the inner surface of the tray not occupied by the product and to close the at least one hole in the side wall.

2. The process according to claim 1 wherein an airtight contact is formed between the film and the rim of the tray before air is evacuated from within the tray through the at least one hole.

3. The process according to claim 1 wherein the film is held in contact with the upper portion of the vacuum chamber by vacuum also while being positioned above the product loaded tray and while an airtight contact is formed between the film and the rim of the tray.

4. The process according to claim 1 wherein the film is positioned above the product loaded tray and secured to the rim of the tray in at least one spot before said product loaded tray is placed in said vacuum chamber.

5. The process according to claim 4 wherein the film is heat-sealed to the whole rim of the tray.

6. The process according to claim 1 wherein the film is a discrete piece of film having the size of the tray.

* * * * *